US006597071B2

(12) United States Patent
Hiyama et al.

(10) Patent No.: US 6,597,071 B2
(45) Date of Patent: Jul. 22, 2003

(54) PRIME MOVER STARTING CONTROL APPARATUS

(75) Inventors: Yasuyuki Hiyama, Anjo (JP); Toyohiko Kano, Anjo (JP); Kazuo Aoki, Anjo (JP); Kenji Suzuki, Anjo (JP); Shingo Hamazaki, Anjo (JP); Naoto Ogasawara, Anjo (JP)

(73) Assignee: Aisin AW Co., Ltd. (JP)

( * ) Notice: Subject to any disclaimer, the term of this patent is extended or adjusted under 35 U.S.C. 154(b) by 2 days.

(21) Appl. No.: 09/962,803

(22) Filed: Sep. 26, 2001

(65) Prior Publication Data

US 2002/0047272 A1 Apr. 25, 2002

(30) Foreign Application Priority Data

Sep. 26, 2000 (JP) ..... 2000-291599
Aug. 27, 2001 (JP) ..... 2001-256976

(51) Int. Cl.[7] ..... F02N 11/00

(52) U.S. Cl. ..... 290/38 R; 322/16; 290/37 A; 123/179.3

(58) Field of Search ..... 290/7, 30 R, 31, 290/36 R, 37 A, 38 R; 123/179.1, 179.3, 179.5; 322/14, 15, 16

(56) References Cited

U.S. PATENT DOCUMENTS 3,857,043 A * 12/1974 Habasch ..... 290/38 R
4,873,950 A * 10/1989 Furuyama ..... 123/179.3
5,612,578 A * 3/1997 Drew ..... 307/10.5
5,689,142 A * 11/1997 Liu ..... 307/10.5
5,927,240 A * 7/1999 Maxon ..... 123/179.3
5,967,106 A * 10/1999 Schulze et al. ..... 123/179.3
6,054,826 A * 4/2000 Murakami et al. ..... 318/471
6,354,257 B1 * 3/2002 Marshall et al. ..... 123/179.3

FOREIGN PATENT DOCUMENTS

JP 2000-136874 5/2000

* cited by examiner

*Primary Examiner*—Nicholas Ponomarenko
(74) *Attorney, Agent, or Firm*—Lorusso, Loud & Kelly

(57) ABSTRACT

The impossibility of starting a starter motor by using a non-contact type position sensor for deciding an engine start is eliminated. An engine starting apparatus includes a non-contact type position sensor for detecting the range position of a drive mechanism having a prime mover as a power source; a control device for the drive mechanism; drive means for driving the prime mover; a power source device for supplying an electric power to the drive means and the control device; and conduction means for making the drive means and the power source device conductive in response to a signal from an ignition switch S and a signal outputted by the control device on the basis of the range position detected by the position sensor. As a result, the starter motor can be started without mounting the contact type start switch.

30 Claims, 7 Drawing Sheets

PRIME MOVER STARTING CONTROL APPARATUS

BACKGROUND OF THE INVENTION

1. Field of the Invention

The present invention relates to a prime mover starting control apparatus and, more particularly, to a starting apparatus for a prime mover as a power source in a drive mechanism of the type for detecting a range position by using a non-contact position sensor.

2. Description of the Related Art

A vehicle having an automatic transmission mounted thereon is provided, as well known in the art, with a neutral start switch which can start a starter motor only in the state where a position sensor for detecting the range position of the automatic transmission detects a non-running range (e.g., N (neutral) range and P (parking) range) position. This neutral start switch is usually integrated with a position sensor of the type in which the range position of the automatic transmission is decided by a control device from the ON/OFF combinations of numerous contacts arranged on multiple concentric circles. And, this switch is so constructed in circuit that it is inserted into either a relay circuit for turning ON/OFF a drive circuit of the starter motor or the drive circuit itself.

So long as the aforementioned contact type construction is used, however, there is an intrinsic limit to the size reduction of the neutral start switch integrated with the position sensor. If the position sensor is replaced by a non-contact type, however, the size can be drastically made compact. In the case of adopting this type, therefore, the neutral start switch is also constructed of a switching circuit which is activated with a signal based on the range position decision of the electronic control device. This non-contact type switch cannot be inserted as the neutral start switch into the drive circuit of the starter motor. It is, therefore, difficult to drive the starter motor in the non-running range of the automatic transmission.

Where the neutral start switch is made of a non-contact type switch, on the other hand, the voltage to be applied to the electronic control device temporarily drops to interrupt the switch ON signal to be outputted on the basis of the range position decision. Therefore, there is supposed a situation in which the starter motor cannot be driven.

Moreover, the output signal of the electronic control device constructing the non-contact type neutral start switch cannot be outputted when the electronic control device fails, so that the starter motor cannot be driven in this state.

SUMMARY OF THE INVENTION

Therefore, the invention has an object to provide a prime mover starting control apparatus which is enabled to ensure a starter motor drive by solving such a trouble as is caused by using the non-contact type position sensor.

In order to achieve the above-specified object, the invention has the following characteristics.

(1) There is provided a prime mover starting control apparatus comprising: a non-contact type position sensor for detecting the range position of a drive mechanism connected to a prime mover acting as a power source; a control device for deciding the range position on the basis of the range position detected at least by the position sensor; and conduction means for making drive means for driving the prime mover and power source device for supplying an electric power to the drive means and the control device, conductive with a signal from an ignition switch and a signal outputted by the control device on the basis of the range position detected by the position sensor.

(2) In the construction as set forth in (1), it is effective that the conduction means includes a signal retaining circuit for retaining the signal outputted by the control device.

(3) In the construction as set forth in (2), it is effective that the signal retaining circuit is a circuit for retaining the present signal till a next signal is given, and for retaining the next signal by canceling the present signal with the next signal.

(4) Specifically, in the construction as set forth in (2), the signal retaining circuit is a logic circuit for retaining the signal inputted to the circuit with a gate output.

(5) In the construction as set forth in (2), it is more effective that the signal retaining circuit is a circuit to be activated with a voltage lower than the working voltage necessary for deciding the range position by the control device, to retain the signal which has been outputted before the reset of the decision of the range position due to the drop of the working voltage of the control device.

(6) Specifically, in the construction as set forth in (2) or (3), the signal retaining circuit is inserted into an output circuit of a signal outputted by the control device on the basis of the decision of the range position.

(7) In the construction as set forth in any of (1) to (6), it is more effective that there is further comprised control safety device in parallel with the control device capable of outputting the signal, as based on the range position detected at least by the position sensor, to the conduction means.

(8) In the construction as set forth in (7), moreover, the control safety device can include an auxiliary control device for outputting a signal on the basis of the range position detected by the position sensor, and the auxiliary control device can warrant the output of the signal to the conduction means when the decision of the range position by the control device is reset.

(9) In the construction as set forth in (7), alternatively, the control safety device includes a comparator circuit for outputting a signal on the basis of the range position detected by the position sensor, and the comparator circuit warrants the output of the signal to the conduction means when the decision of the range position by the control device is reset.

(10) In the construction as set forth in (7), alternatively, the position sensor is a digital sensor; the control safety device includes a decoder for converting the signal outputted by the digital sensor into a range position signal and for outputting the range position signal; and the decoder warrants the output of the signal to the conduction means when the decision of the range position by the control device is reset.

(11) In the construction as set forth in (7), alternatively, the position sensor is an analog sensor; the control safety device includes a comparator circuit for deciding the range position from the signal outputted by the analog sensor and for outputting the signal; and the comparator circuit warrants the output of the signal to the conduction means when the decision of the range position by the control device is reset.

(12) In the construction as set forth in any of (2) to (11), the signal retaining circuit is a flip-flop circuit.

(13) Specifically, in the construction as set forth in (12), the flip-flop circuit inputs a decision signal of the range position and a position changing signal outputted at each change of the decision signal and outputs the decision signal of the range position outputted at the rise of the position changing signal, as the signal to the conduction means.

(14) In the construction as set forth in any of (1) to (13), the range position is a non-running range position.

(15) Next, there is provided a prime mover starting control apparatus, which comprises a non-contact type position sensor for detecting the range position of a drive mechanism connected to a prime mover acting as a power source; and a control device for deciding the range position on the basis of the range position detected at least by the position sensor, wherein the control device outputs a signal for making drive means for driving the prime mover and a power source device for supplying an electric power to the drive means and the control device, conductive on the basis of the range position detected by the position sensor.

(16) In the construction as set forth in (15), it is effective that there is further comprised is a signal retaining circuit for retaining the signal outputted by the control device.

(17) In the construction as set forth in (16), it is effective that the signal retaining circuit is a circuit for retaining the present signal till a next signal is given, and for retaining the next signal by canceling the present signal with the next signal.

(18) Specifically, in the construction as set forth in (16), the signal retaining circuit is a logic circuit for retaining the signal inputted to the circuit with a gate output.

(19) In the construction as set forth in (16), it is more effective that the signal retaining circuit is a circuit to be activated with a voltage lower than the working voltage necessary for deciding the range position by the control device, to retain the signal which has been outputted before the reset of the decision of the range position due to the drop of the working voltage of the control device.

(20) Specifically, in the construction as set forth in (16) or (17), the signal retaining circuit is inserted into an output circuit of a signal outputted by the control device on the basis of the decision of the range position.

(21) In the construction as set forth in any of (15) to (20), it is more effective that there is further comprised control safety device in parallel with the control device, and that the control safety device can output the signal, as based on the range position detected at least by the position sensor, as a signal for making the drive means for driving the prime mover and the power source device for supplying the electric power to the drive means and the control means, conductive.

(22) In the construction as set forth in (21), moreover, the control safety device can include an auxiliary control device for outputting a signal on the basis of the range position detected by the position sensor, and the auxiliary control device can warrant the output of the signal for making the drive means for driving the prime mover and the power source device for supplying the electric power to the drive means and the control device, conductive when the decision of the range position by the control device is reset.

(23) In the construction as set forth in any of (15) to (22), the range position is a non-running range position.

In the construction of the invention as set forth in (1) above, the prime mover starting control apparatus for the drive mechanism to detect the range position with the non-contact type position sensor can start the prime mover reliably according to the range position.

Next, in the construction as set forth in (2) above, the prime mover starting control apparatus for the drive mechanism to detect the range position with the non-contact type position sensor is enabled to start the prime mover of the case, in which the range position decision by the control device is reset for some cause, only by retaining the signal which has been outputted from the control device.

In the construction as set forth in (3) above, on the other hand, the signal retaining circuit retains the previous signal reliably till the next signal is given. Even where the range position decision by the control device is reset by some cause, therefore, the prime mover can be reliably started with the signal outputted at first from the control device. Moreover, the signal of the case, in which the range position decision by the control device is restored, is updated without any trouble.

In the construction as set forth in (4) above, on the other hand, the retention of the signal by the signal retaining circuit is made only by the pure circuit action activated with the output signal of the control device. Therefore, the impossibility of starting the prime mover by the reset of the range position decision of the control device can be eliminated without consuming the memory of the control device and loading the operations.

Next, in the construction as set forth in (5) above, the prime mover can be started where the reason for resetting the range position decision by the control device is a voltage drop. Where the voltage of the power source device is restored, moreover, it is possible to eliminate the influences of the range position decision from the provision of the signal retaining circuit.

In the construction as set forth in (6) above, on the other hand, the signal retaining circuit can be given such a simple circuit construction as to activate the signal retaining circuit with the output signal of the control device.

In the construction as set forth in (7) above, on the other hand, even where the control device fails by some cause to output the signal, the impossibility of starting the prime mover can be eliminated by the signal outputted by the control safety device.

In the construction as set forth in (8) above, on the other hand, even where the control device fails by some cause to output the signal, the impossibility of starting the prime mover can be eliminated because the auxiliary control device warrants the action of the control device. Moreover, the auxiliary control device can monitor the action of the control device.

In the construction as set forth in (9) above, on the other hand, even where the control device fails by some cause to output the signal, the impossibility of starting the prime mover can be eliminated because the signal outputted by the comparator circuit warrants the impossibility of outputting the signal from the control device. On the other hand, the signal by the comparator circuit is outputted by the pure circuit action made with the output signal of the position sensor so that the signal retaining warrant can be achieved by using neither the memory nor operations for the signal retention.

In the construction as set forth in (10) above, on the other hand, even where the control device fails by some cause to output the signal, the impossibility of starting the prime mover can be eliminated because the signal outputted by the decoder warrants the impossibility of outputting the signal from the control device. On the other hand, the signal by the decoder is outputted by the pure circuit action made with the output signal of the position sensor so that the signal retaining warrant can be achieved by using neither the memory nor operations for the signal retention.

In the construction as set forth in (11) above, on the other hand, even where the control device fails by some cause to output the signal, the impossibility of starting the prime mover can be eliminated because the signal outputted by the comparator circuit warrants the impossibility of outputting the signal from the control device. On the other hand, the signal by the comparator circuit is outputted by the pure circuit action made with the output signal of the position sensor so that the signal retaining warrant can be achieved by using neither the memory nor operations for the signal retention. By making the position sensor of the analog sensor, moreover, the number of detection elements can be reduced to reduce the size of the position sensor.

In the construction as set forth in (12) above, on the other hand, the signal retaining circuit can be made of the existing IC chip.

In the construction as set forth in (13) above, on the other hand, the retention of the output signal of the control device by the signal retaining circuit can be achieved only by the switching action of the circuit.

In the construction as set forth in (14) above, on the other hand, the prime mover can be reliably started at the non-running range position of the drive mechanism.

In the construction of the invention as set forth in (15) above, the prime mover starting control apparatus for the drive mechanism to detect the range position with the non-contact type position sensor can start the prime mover reliably according to the range position.

Next, in the construction as set forth in (16) above, the prime mover starting control apparatus for the drive mechanism to detect the range position with the non-contact type position sensor is enabled to start the prime mover of the case, in which the range position decision by the control device is reset for some cause, only by retaining the signal which has been outputted from the control device.

In the construction as set forth in (17) above, on the other hand, the signal retaining circuit retains the previous signal reliably till the next signal is given. Even where the range position decision by the control device is reset by some cause, therefore, the prime mover can be reliably started with the signal outputted at first from the control device. Moreover, the signal of the case, in which the range position decision by the control device is restored, is updated without any trouble.

In the construction as set forth in (18) above, on the other hand, the retention of the signal by the signal retaining circuit is made only by the pure circuit action activated with the output signal of the control device. Therefore, the impossibility of starting the prime mover by the reset of the range position decision of the control device can be eliminated without consuming the memory of the control device and loading the operations.

Next, in the construction as set forth in (19) above, the prime mover can be started where the reason for resetting the range position decision by the control device is a voltage drop. Where the voltage of the power source device is restored, moreover, it is possible to eliminate the influences of the range position decision from the provision of the signal retaining circuit.

In the construction as set forth in (20) above, on the other hand, the signal retaining circuit can be given such a simple circuit construction as to activate the signal retaining circuit with the output signal of the control device.

In the construction as set forth in (21) above, on the other hand, even where the control device fails by some cause to output the signal, the impossibility of starting the prime mover can be eliminated by the signal outputted by the control safety device.

In the construction as set forth in (22) above, on the other hand, even where the control device fails by some cause to output the signal, the impossibility of starting the prime mover can be eliminated because the auxiliary control device warrants the action of the control device. Moreover, the auxiliary control device can monitor the action of the control device.

In the construction as set forth in (23) above, on the other hand, the prime mover can be reliably started at the non-running range position of the drive mechanism.

DESCRIPTION OF THE PREFERRED EMBODIMENTS

Figure 1:
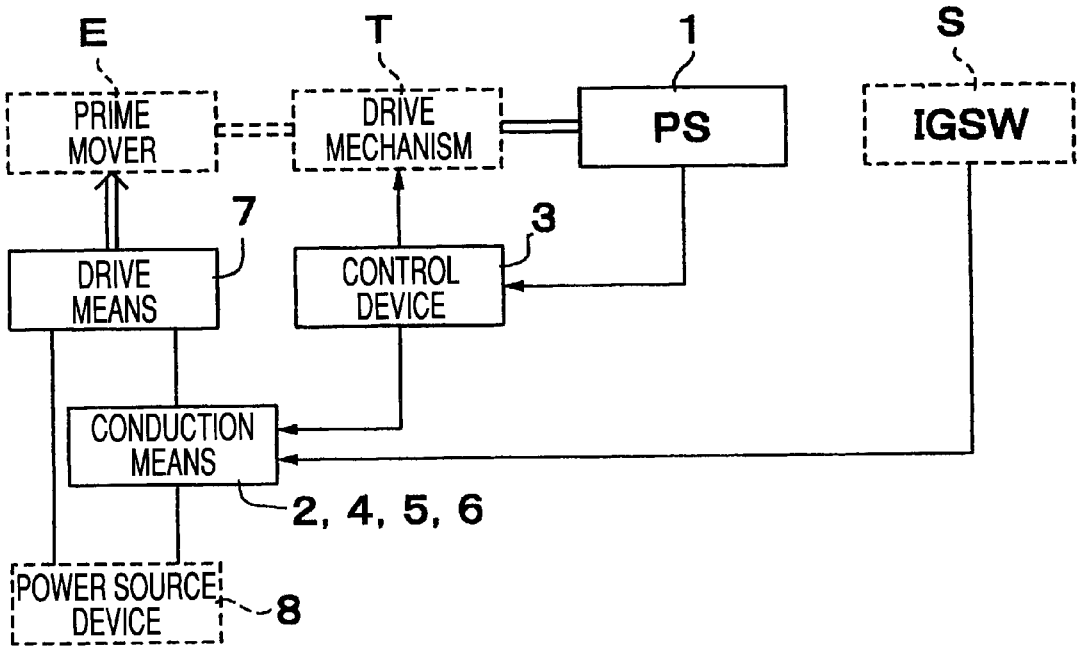
FIG. 1 is a block diagram showing a system construction of an engine starting apparatus of the invention conceptionally.

The invention will be described in connection with its embodiments with reference to the accompanying drawings. FIG. 1 is a block diagram showing a system construction of a prime mover start control apparatus of the invention conceptionally. A prime mover E to be controlled by the starter device is an internal or external engine of any type (as will be called the "engine" in the description of the embodiments) or a driving electric motor of an electric car. A drive mechanism T is a discontinuous or continuous automatic transmission for operating a start and a speed change automatically, a semiautomatic transmission for automating the starting operation and for changing a gear stage manually, a continuously variable transmission capable of controlling the gear ratio of a gear stage continuously, or an electric motor of a hybrid car having an engine and an electric motor mounted together.

This apparatus includes: a non-contact type position sensor (PS) 1 for detecting the range position of the drive mechanism T; control device 3 of the drive mechanism T; drive means 7 for driving the engine (or prime mover) E; a power source device 8 for supplying an electric power to the drive means 7 and the control device 3; and conduction means 2, 4, 5 and 6 for turning the drive means 7 and the power source device 8 conductive in response to a signal from an ignition switch (as called so herein, including a starter switch generally built in the ignition switch) S and a signal from the control device 3, as based on the range position detected by the position sensor 1.

Figure 2:
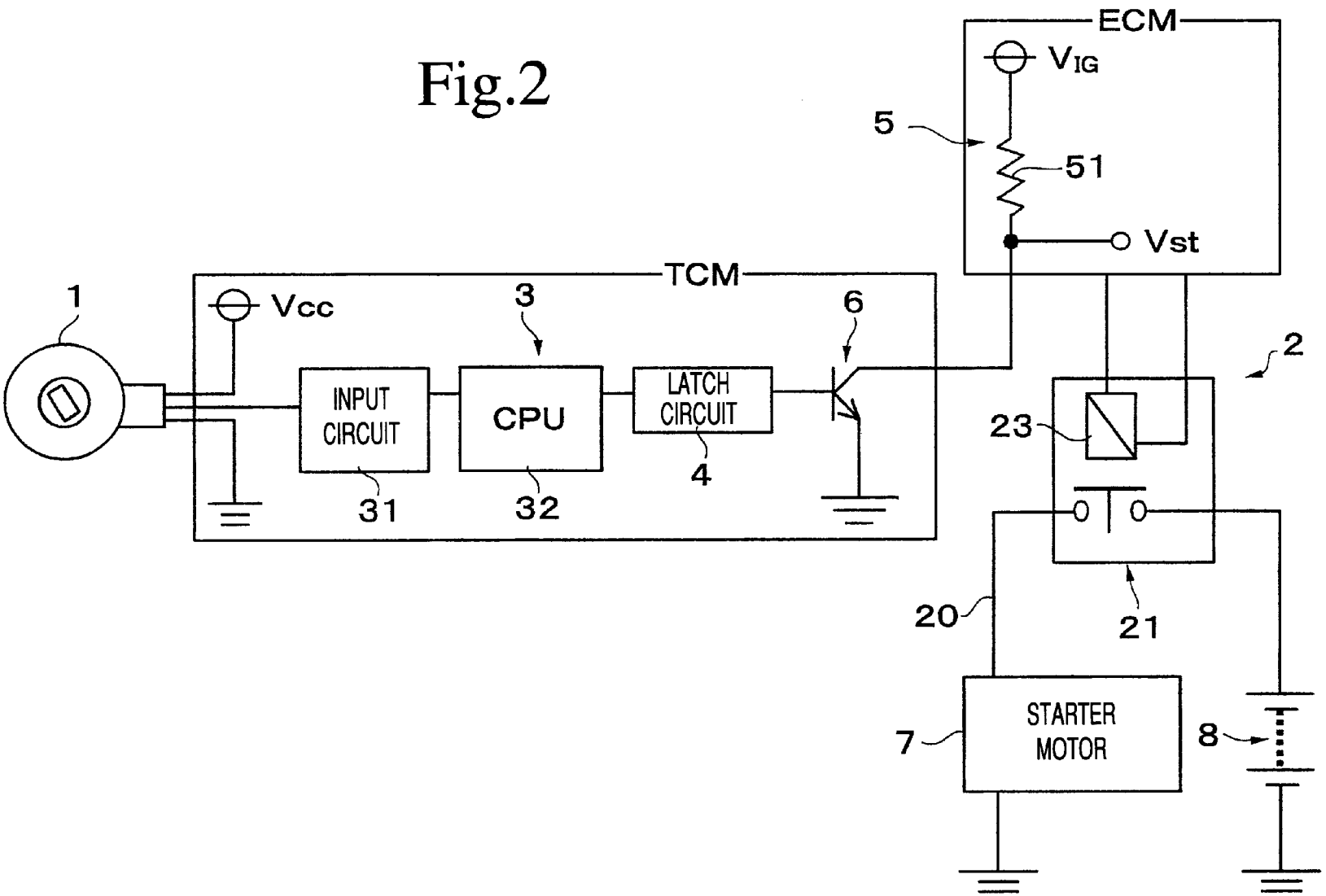
FIG. 2 is a block diagram showing a system construction of an engine starting apparatus according to a first embodiment of the invention.

FIG. 2 is a block diagram showing a system construction of a first embodiment of the engine starting apparatus of the invention. The non-contact type position sensor 1 in this apparatus is constructed, where the automatic transmission is used as the drive mechanism, to include: a detection unit having a magnet to be rotationally displaced by a manual shaft or a movable member connected to the actuation shaft of the manual valve of the hydraulic control device of the automatic transmission, and a Hall IC for detecting the lines of magnetic force of the magnet; and an analog output active sensor for outputting the change in the angular position of the manual shaft as a change in the voltage value. The position sensor 1 shares its power source with the power source of the control device 3 so that it is activated when fed with the voltage (Vcc) of the latter.

The control device 3 is built in a transmission control module (TCM) to be assembled in an electronic control device for controlling the automatic transmission, and includes: an input circuit 31 for fetching the signal of the position sensor 1, as also assembled in the electronic control device; a microcomputer (CPU) 32; and the switching circuit 6 constructing the output circuit of the control device 3 and functioning as the neutral start switch. In this control device 3, the output voltage of the position sensor 1, as inputted to the input circuit 31, is recognized as the angular position of the manual shaft by the microcomputer 32 so that the range position such as P, R (Reverse), N, D (Drive) and L (Low) of the automatic transmission is decided from the corresponding relation between the angular position and the switching position of the manual valve. This control device 3 is so connected with the engine control module (ECM) 5 as to activate a starter relay 21 inserted into the drive circuit 2 of the starter motor 7 as the drive means.

The drive circuit 2 of the starter motor 7 controls the starter relay 21, as inserted into a power line 20 of the starter motor 7, with a starter signal (Vst) and is activated by the battery power source 8. The engine control module (ECM) used as the conduction means in this embodiment is equipped with: a detection circuit for detecting the voltage on the ground side of a detection resistor 51 built in a circuit made conductive in response to the starter ON (with an application of an ignition voltage $V_{IG}$) of the not-shown ignition switch, to output the starter signal (Vst) for activating a relay circuit; and a relay drive circuit for controlling the ON/OFF of the drive current of a relay coil 23 in response to the High/Low of the starter signal (Vst). For this engine control module (ECM), the switching circuit 6 accompanying the control device 3 built in the automatic transmission control module (TCM) in this embodiment is connected with the ground side of the detection resistor 51. In this system construction, therefore, the starter motor drive circuit 2, the engine control module (ECM) and the switching circuit 6 construct the conduction means for making the starter motor 7 as the drive means and the battery 8 as the power source device conductive.

With the device thus constructed, by the microcomputer 32 for fetching the signal of the position sensor 1 through the input circuit 31, the range position such as P, R (Reverse), N, D (Drive) and L (Low) of the automatic transmission is decided from the corresponding relation between the angular position of the manual shaft and the switching position of the manual valve. When this decision is the P-range or the N-range, a start allowing signal is outputted from the microcomputer 32 to the switching circuit 6, and the switching circuit 6 is activated to earth the detection resistor 51 to the ground so that the starter signal (Vst) for the starter relay action is outputted. When the ignition switch is the starter ON, therefore, the relay drive current is outputted to the relay coil 23. As a result, the contact of the starter relay 21 of the power line 20 is closed to drive the starter motor 7.

Thus, according to this engine start control apparatus, the engine E can be reliably started in response to the P-range or N-range position in the drive mechanism T in which the range position is detected by the non-contact type position sensor 1.

Here, the engine can be started when the range position is decided by the microcomputer 32 of the control device 3, as described above. At the starting time of the stator motor 7, however, this stator motor 7 is caused to consume a high current by the cranking load at the beginning of the start of the engine E. The supply voltage (Vcc) for activating the microcomputer 32 sharing the battery 8 as the common power source to decide the range position is lowered by as short as several milliseconds. Although instantly, the voltage to the control device 3 drops so that the once obtained range decision of the microcomputer 32 is reset so that the start allowing signal is not outputted to make the engine start difficult. Especially when the battery 8 is seriously short of the charge, the voltage drop is prominent.

In this embodiment, therefore, the switching circuit 6 as the conduction means is provided with a signal latching circuit (as will be called the "latch circuit" in the description of the embodiment) 4 for latching the start allowing signal. This latch circuit 4 is inserted into the output circuit of the control device 3. Specifically, in this apparatus, the position sensor 1, the microcomputer 32 of the control device 3, and the latch circuit 4 are connected in series with each other in the recited order. The latch circuit 4 is constituted by a circuit activated by either a voltage lower than the working voltage necessary for deciding the range position with the microcomputer 32 of the control device 3 or a not-shown backup voltage other than the battery 8, to latch the output (or the signal to be outputted through the latch circuit 4 will be called the "starter lock signal" in the following description of the embodiment) of the start allowing signal to the switching circuit 6 even at the time of resetting the decision of the range position due to the drop of the working voltage of the control device 3. This working voltage region of the microcomputer 32 and the latch circuit 4 can be altered by the elements composing them. From this aspect, the working voltage region of the latch circuit 4 is made operative at least in the voltage region, in which the engine control apparatus or the vehicle control apparatus for controlling the engine E is active, to latch the starter lock signal and retain the drive state of the stator motor.

Figure 3:
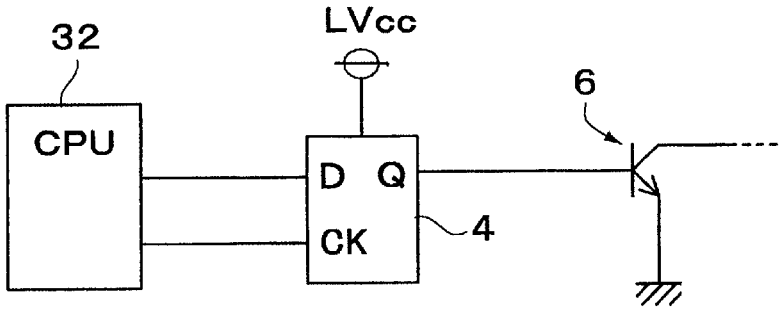
FIG. 3 is a schematic circuit diagram showing a start allowing signal retaining circuit of the engine starting apparatus.

FIG. 3 shows a specific example of the latch circuit 4, which is constructed of a flip-flop circuit in this example. Specifically, the flip-flop circuit is constructed of a D-flip-flop IC. Where the power source (LVcc) of this circuit is shared with the power source of the control device 3, it is assumed that the range position decision of the microcomputer 32 comes into the reset state at a voltage. If an IC of a lower voltage drive is then used, the starter lock signal can be retained even while the range position decision is reset.

Figure 4:
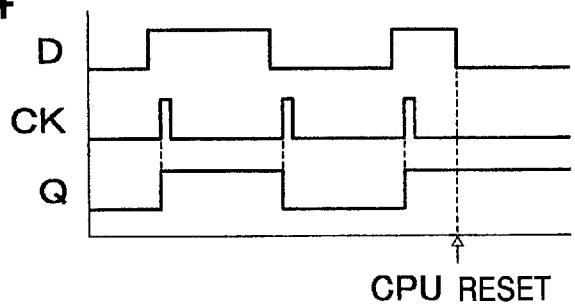
FIG. 4 is a time chart illustrating the actions of the start allowing signal retaining circuit.

FIG. 4 is a time chart illustrating the working principle of the D-flip-flop IC. The input of a D-pin is outputted to a Q-pin each time the input of the CK pin is high. By setting the input to the D-pin high when the P-range or N-range is decided by the microcomputer 32 and by setting the pulse signal high as the range switching signal and inputting it to the CK pin after the shift position change, therefore, the D-pin signal at the rising time of the pulse signal is outputted from the Q-pin. In this circuit, therefore, the high output of the Q-pin can be made into the starter lock signal by making that signal into the switching signal of the switching circuit 6.

With this circuit construction, the feed voltage (Vcc) to the Hall IC of the position sensor 1 drastically drops, and the feed voltage to the control device 3 for deciding the range position drops with the signal from the position sensor 1 so that the microcomputer 32 for deciding the signal comes into the reset state. Then, none of the signals to the D-pin and the CK-pin of the flip-flop IC is outputted (where the position for this state is designated by the "CPU reset" in the time chart of FIG. 4) so that the flip-flop IC continues outputting the high signal of the Q-pin. As a result, the starter lock signal is kept, but the switching circuit 6 is not switched, so that the drive of the starter motor 7 is not interrupted by the reset of the microcomputer 32. And, this state is so conditioned by the recovery of the power voltage that it is reset by the prevailing signal of the D-pin when the signal is inputted again to the CK-pin by changing the shift position.

Thus, in this engine start control apparatus, when the start allowing signal is outputted from the microcomputer 32 by setting the P-range or the N-range, the starter relay 21 is activated to close the relay contact so that the power line 20 is made conductive to drive the starter motor 7. Even if an extreme voltage drop occurs to bring the microcomputer 32 into the reset state for the range position decision, therefore, the starter lock signal by the flip-flop circuit 4 is retained to keep the conduction of the starter motor drive circuit 2 of the starter relay action by the switching circuit 6. Therefore, the conduction of the power line 20 is also kept so that the drive state of the stator motor 7 once started is continued without being influenced by the reset of the range position of the microcomputer 32.

Figure 5:
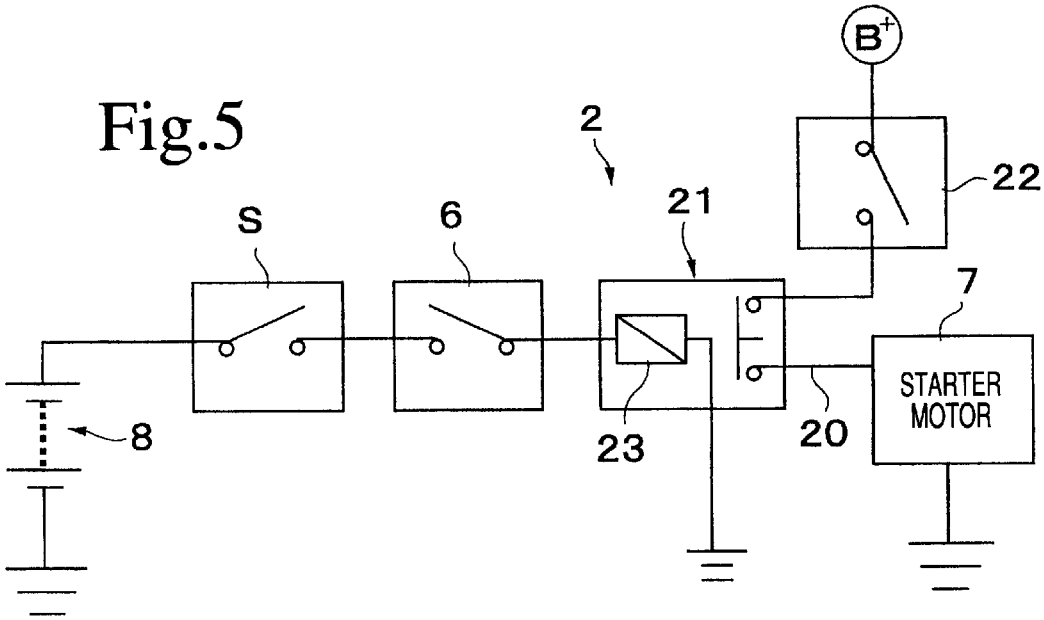
FIG. 5 is a system construction diagram showing a modification of a starter motor drive circuit.

Next, FIG. 5 shows a modification of the conduction means. In the preceding first embodiment, the signal (Vst) of the engine control module (ECM) is used as the starter ON signal of the ignition switch S in a portion of the conduction means. However, this embodiment adopts a construction in which the contact type ignition switch S and the non-contact neutral start switch 6 are arranged in series with the conduction means. With the battery 8, specifically, there are arranged in a series connection the ignition switch S, the neutral start switch 6 and the relay coil 23. In the power line 20, a starter switch 22, the starter relay 21 and the stator motor 7 are connected in series with a battery power source (B+) and are grounded to the earth. Although the neutral start switch 6 is schematically shown by a switch symbol, the switch is constructed of a non-contact switch made of the switching circuit 6 which is activated with the start lock signal coming from the foregoing latch circuit 4 shown in FIG. 3.

In the case of this circuit construction, when both the ignition switch S and neutral start switch 6 are closed, the power line 20 is brought into the drive standby state of the stator motor 7 by the action of the starter relay 21 of the drive circuit 2. When the power line 20 is turned conductive by the ON action of the starter switch 22 of the ignition switch S, therefore, the stator motor 7 is actually started to begin the engine start.

Figure 6:
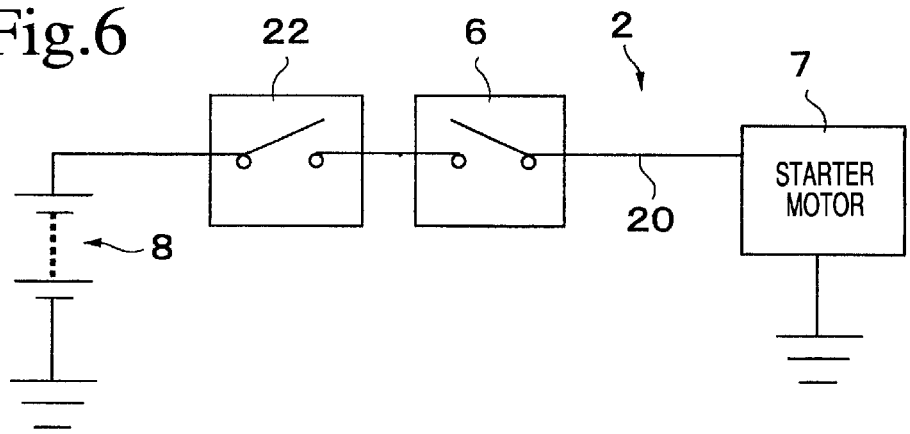
FIG. 6 is a system construction diagram showing another modification of the starter motor drive circuit.

Next, FIG. 6 shows another modification of the conduction means. This modification omits the relay circuit and adopts a construction in which the starter switch 22 of the ignition switch S and the neutral start switch 6 are arranged in series with the stator motor 7. In other words, the starter switch 22, the neutral start switch 6 and the stator motor 7 are arranged in a series connection with the battery 8 as the power source device. In this construction, therefore, the drive circuit 2 is constructed of only the power line. In this case, too, the neutral start switch 6 is schematically shown by the switch symbol. Specifically, this switch is constructed as the non-contact switch which is composed of the switching circuit 6 to be activated with the start lock signal coming from the aforementioned latch circuit 4 shown in FIG. 3. In the case of this modification, the switching circuit 6 conducts the high current of the power line directly, but the construction of the conduction means is simplified.

Figure 7:
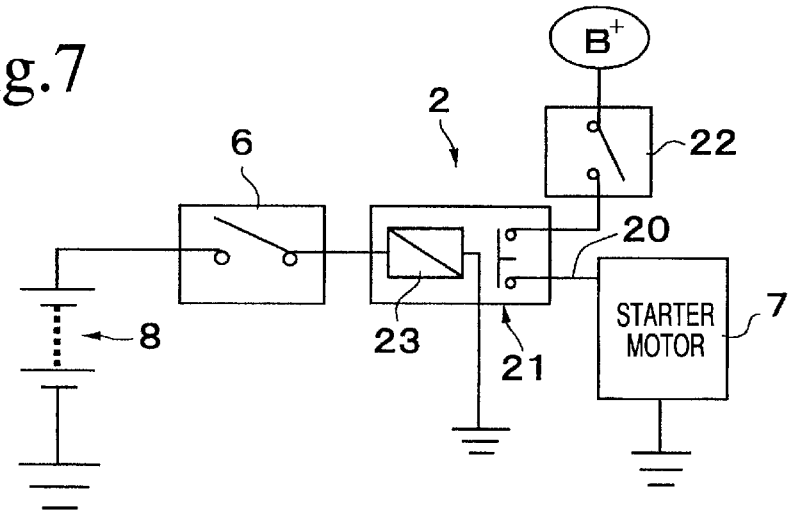
FIG. 7 is a system construction diagram showing still another modification of the starter motor drive circuit.

Next, FIG. 7 shows still another modification of the conduction means. This modification is made by omitting the ignition switch on the relay circuit from the preceding modification shown in FIG. 5. The remaining constructions are substantially similar to those of the modification shown in FIG. 5 so that the corresponding components will not be described by designating them by similar reference characters. In this case, too, the neutral start switch 6 is schematically shown by the switch symbol. Specifically, this switch is constructed of a non-contact switch which is made of the switching circuit 6 to be activated with the start lock signal coming from the aforementioned latch circuit 4 shown in FIG. 3.

With the aforementioned construction of the first embodiment, it is possible to warrant the stator motor drive against the voltage drop of the control device 3. Where the control device per se fails by some cause so that it can neither decide the range position nor output the resultant start allowing signal, however, the stator motor drive is not warranted. Therefore, here will be described an embodiment of the system construction which can warrant the drive even in that event.

Figure 8:
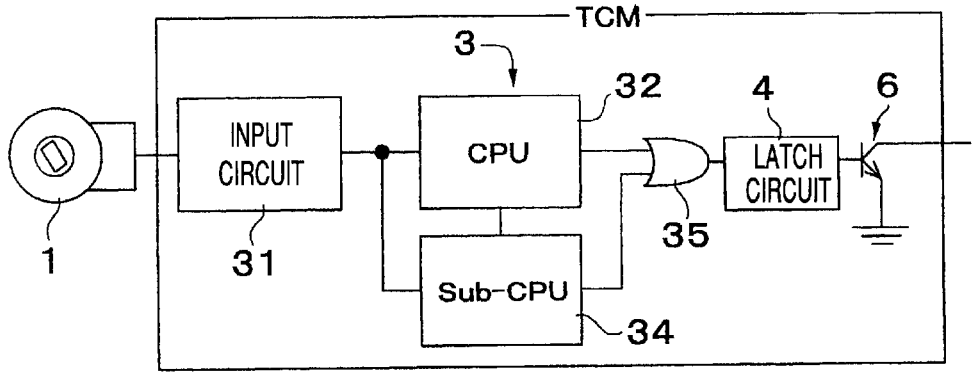
FIG. 8 is a block diagram showing a system construction of an engine starting apparatus according to a second embodiment of the invention.

Next, FIG. 8 shows a second embodiment of the invention, in which the system construction is modified from that of the aforementioned first embodiment. In this second embodiment, there is provided warrant means for the microcomputer 32. In this embodiment, there is adopted a construction, in which the microcomputer 32 and a sub-microcomputer 34 as a parallel auxiliary control device are so arranged between the input circuit 31 and the latch circuit 4 that their outputs are connected with the latch circuit 4 through an OR logic circuit 35 made of a logic IC. In short, in this embodiment, the position sensor 1, the microcomputer 32 and the sub-microcomputer 34 of the control device 3, and the latch circuit 4 are connected in series with each other. The sub-microcomputer 34 of this case may be made similar to the microcomputer 32 or may have a restricted function. On the other hand, the power source of the sub-microcomputer 34 is shared, like the case of the latch circuit 4, with that of the microcomputer 32, when the simple construction is stressed, and is given an intrinsic backup power source when the more reliability of the working warrant is stressed. The remaining constructions are substantially similar to those of the aforementioned first embodiment so that the corresponding components will not be described by designating them by similar reference characters. In the case of this system construction, the conduction means for controlling the power line of the stator motor can be exemplified by any of the foregoing individual conduction means.

The range position deciding actions of those two microcomputers 32 and 34 will not be described because they are similar to those of the aforementioned first embodiment. With these parallel arrangement of the two microcomputers 32 and 34, the start allowing signal, as outputted from one of them, is outputted through the OR logic circuit 35 to the latch circuit 4 thereby to create the starter lock signal. According to this embodiment, it is possible to warrant both the low voltage action by the latch circuit 4 when the battery voltage drops and the failure of the microcomputer 32 by the sub-microcomputer 34, so that the star lock signal is kept more reliably. Here in the case of this embodiment, it is possible to confirm the failure to monitor the actions of the microcomputer 32 by the sub-microcomputer 34.

Figure 9:
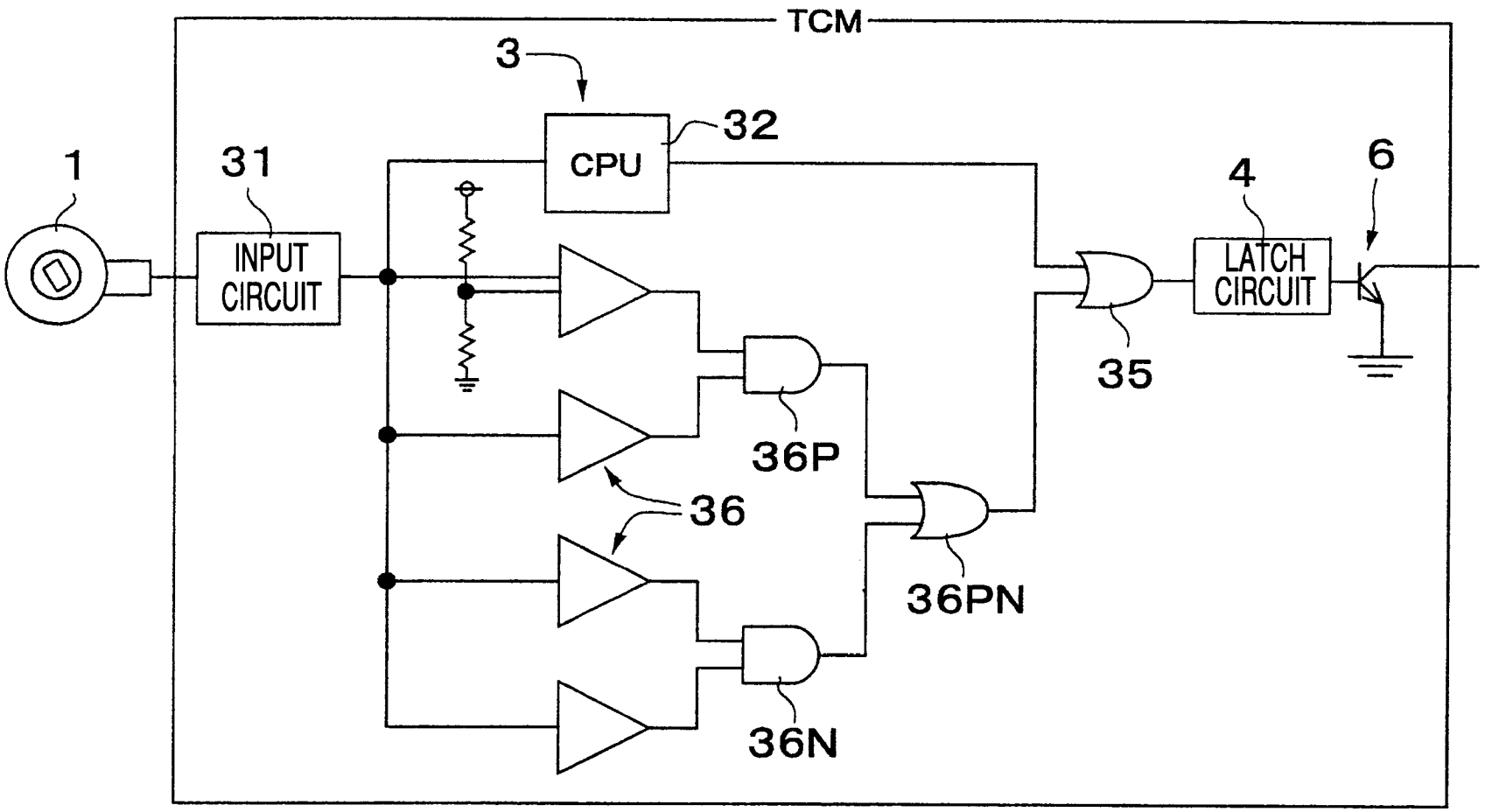
FIG. 9 is a block diagram showing a system construction of an engine starting apparatus according to a third embodiment of the invention.

Next, FIG. 9 shows a third embodiment of the invention. In this embodiment, the warrant means for the microcomputer 32 is replaced by a comparator circuit 36. In this embodiment, for the input circuit 31 and the OR logic circuit 35, the four comparator circuits 36 are connected in parallel with the microcomputer 32. In this system construction, too, there is followed the construction in which the position sensor 1, the microcomputer 32 and the comparator circuits 36 of the control device 3, and the latch circuit 4 are connected in series with each other. The comparator circuit 36 of this case is constructed of a logic IC for turning ON/OFF the output of the applied voltage each time the input exceeds a threshold value. By using this action, the P-position and the N-position of the range positions are specified to effect the circuit action in which the start allowing signal is inputted to one input of the OR logic circuit 35 in accordance with the specified position. For these actions, the circuit constructions are made such that the output sides of two parallel pairs of comparator circuit 36 for determining the individual lower and upper limits of the two threshold values are connected with the input terminals of AND logic circuits 36P and 36N, such that the output sides of the two AND logic circuits 36P and 36N are connected with the two input terminals of an OR logic circuit 36PN, and such that the output of the gate of the OR logic circuit 36PN is inputted to one input of the OR logic circuit 35. In the microcomputer 32, on the other hand, similar operations are made according to the program of a memory so that the start allowing signal is inputted to the other input of the OR logic circuit 35 The remaining constructions are substantially similar to those of the aforementioned individual embodiments so that the corresponding components will not be described by designating them by similar reference characters. In the case of this system construction, too, any of the individual conduction means thus far exemplified can be used as the conduction means for controlling the power line of the stator motor.

Figure 10:
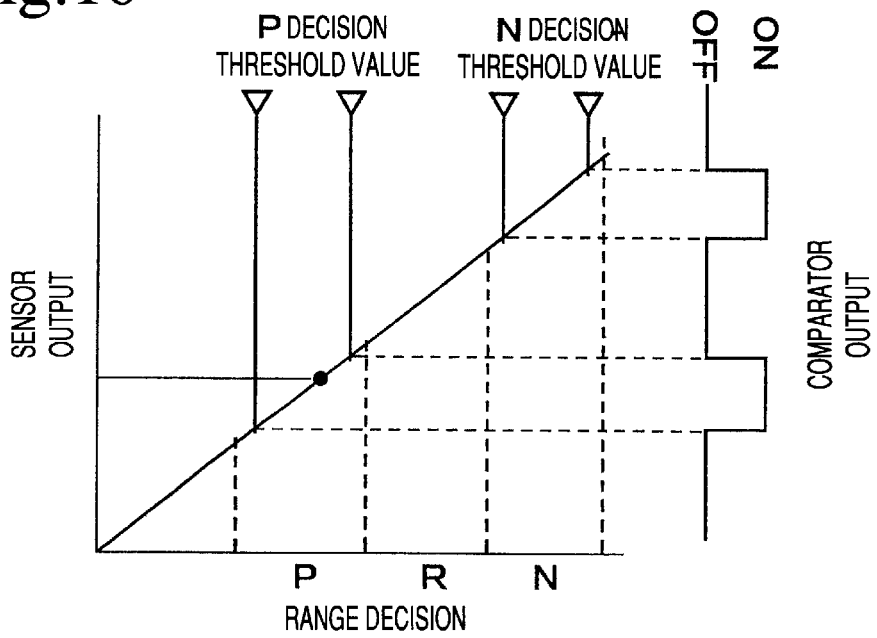
FIG. 10 is a graph illustrating a method for deciding a range position by a comparator of the third embodiment.

FIG. 10 illustrates the signal processing contents by the four comparator circuits 36. The signal voltage (or the sensor output) of the position sensor 1 or the analog output, as described hereinbefore, has a relation to rise according to the angle of rotation, as indicated by a rightward rising solid line. If this voltage is assigned sequentially to the R- and N-positions (although the D-position and later are omitted) according to the arranged order of the range positions by setting the lowest voltage side to the P-position, therefore, there holds a relation in which the voltage width corresponding to the range width, as indicated by longitudinal broken lines, corresponds to each position. In order to enhance the decision accuracy of the range position, on the other hand, the threshold values (i.e., the voltages corresponding to the intersection points between the longitudinal solid lines and the rightward rising solid lines) set as the lower and upper limits of the decision voltage are set as the input voltages of the comparator within the voltage ranges of the individual positions. Thus, the comparator circuit 36 turns ON/OFF the output of the applied voltage within the range of that input voltage so that the ON of this signal can be used as the start allowing signal. Here, where the voltage of the sensor output takes a value, as indicated by a symbol ●, the range is decided at P so that the start allowing signal can be outputted when the comparator output is ON. This relation between the sensor output and the comparator output ON is absolutely identical to that for the N-range.

Where the microcomputer 32 is caused for some reason to reset the range decision by the signal from the position sensor 1 thereby to output no start allowing signal, according to this embodiment, the start allowing signal is outputted through the OR logic circuit 35 by the pure circuit action of the switching action of the comparator circuit 36. As a result, the starter lock signal is kept through the latch circuit 4 so that the action failure of the microcomputer 32 is warranted by the comparator circuit 36.

Figure 11:
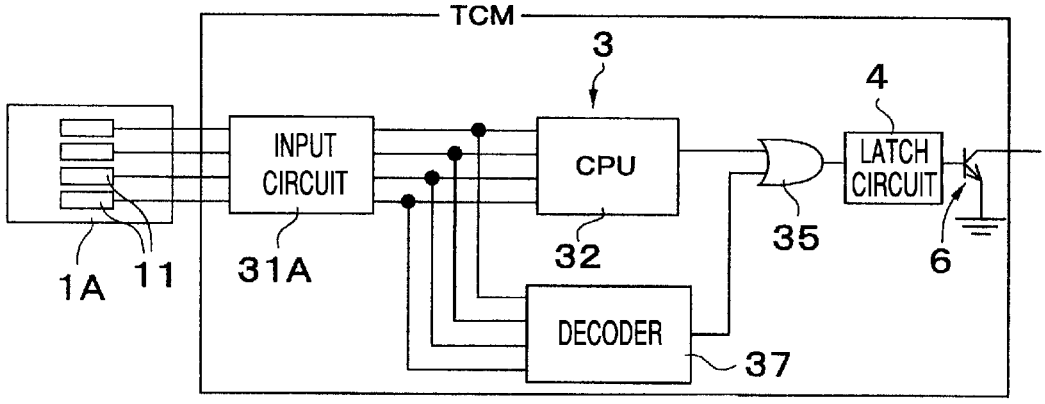
FIG. 11 is a block diagram showing a system construction of an engine starting apparatus according to a fourth embodiment of the invention.

Next, FIG. 11 shows a fourth embodiment of the invention. This embodiment replaces the non-contact type position sensor 1 by a digital output sensor. In the case of this embodiment, a position sensor 1A is exemplified by an active sensor having four Hall ICs as detection elements for outputting four ON/OFF signals. In accordance with this replacement, an input circuit 31A is also constructed to process signals of four lines so that the processed outputs are inputted in parallel to the microcomputer 32 and a decoder 37. In this system construction, too, there is followed the construction in which the position sensor 1A, the microcomputer 32 and the decoder 37 of the control device 3, and the latch circuit 4 are connected in series with each other. The decoder 37 of this case is made of a logic IC to perform a circuit action to discriminate the P-position or the N-position, or a combination for specifying the two positions from the combinations of the inputs of the four lines, thereby to input the start allowing signal to one input of the OR logic circuit 35 in accordance with the discrimination. In the microcomputer 32, on the other hand, all the range positions are decided from the combinations of the four signals by the operations according to the program of the memory so that the start allowing signal when the P-position, the N-position or these positions are decided is inputted to the other input of the OR logic circuit 35. Here, the remaining constructions are substantially similar to those of the aforementioned individual embodiments so that the corresponding components will not be described by designating them by similar reference characters. In the case of this system construction, too, the conduction means for controlling the power line of the stator motor can be exemplified by any of the foregoing individual conduction means.

In this embodiment, too, where the microcomputer 32 resets by some cause the range decision with the signal from the position sensor 1A, the start allowing signal is outputted through the OR logic circuit 35 by the pure circuit action of only the switching action by the logic of the decoder 37 so that the action failure of the microcomputer 32 is warranted by the decoder 37 by keeping the starter lock signal through the latch circuit 4.

Figure 12:
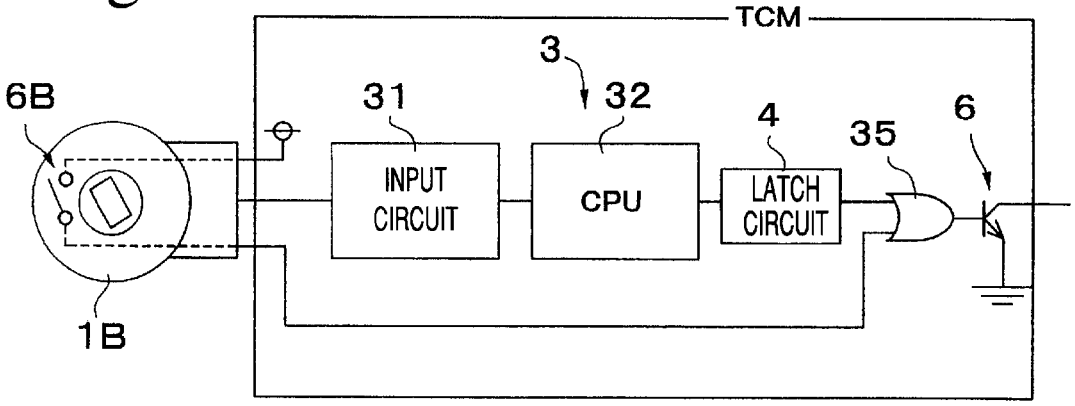
FIG. 12 is a block diagram showing a system construction of an engine starting apparatus according to a fifth embodiment of the invention.

Next, FIG. 12 shows a fifth embodiment of the invention. This embodiment adopts a system construction for warranting the reset of the start allowing signal by mounting a switch for detecting the starting range position as the contact type switch. The switch of this case may be disposed at any place. In the case of the shown embodiments however, a switch 6B to be closed at the P-position and the N-position is built in a position sensor 1B so that the voltage of the signal power source (Vcc) is fed to one input of the OR logic circuit 35 through the switch 6B. There remaining constructions are similar to those of the aforementioned individual embodiments so that the corresponding components will not be described by designating them by similar reference characters. In the case of this system construction, too, the conduction means for controlling the power line of the stator motor can be exemplified by any of the foregoing individual conduction means.

Even where the start allowing signal is not outputted for some cause including the battery voltage drop from the microcomputer 32, according to this embodiment, the start allowing signal through the switch 6B is outputted to the latch circuit 4 through the OR logic circuit 35 so that the starter lock signal is outputted to the switching circuit 6 thereby to activate the switching circuit 6.

Figure 13:
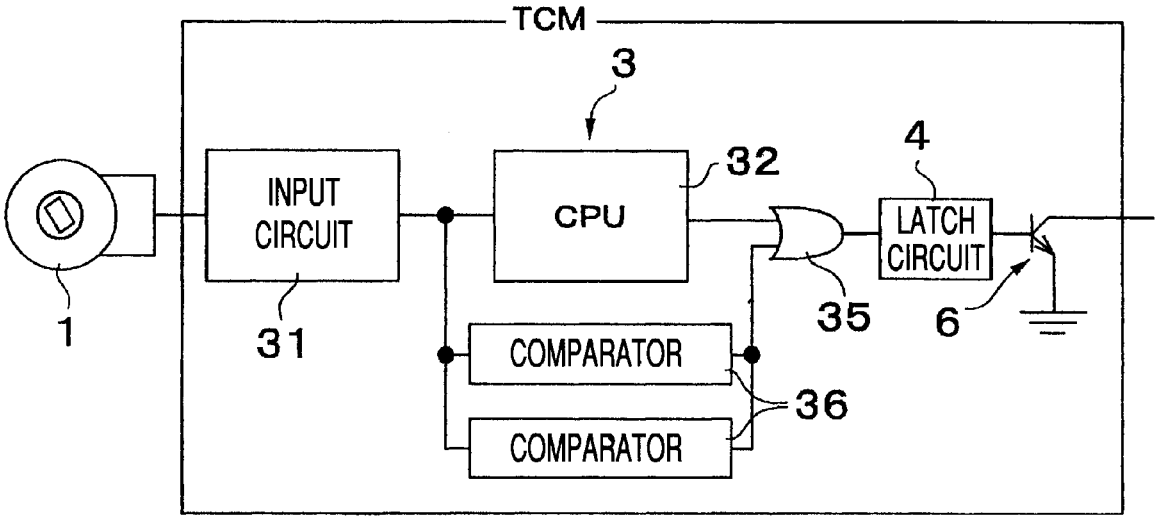
FIG. 13 is a block diagram showing a system construction of an engine starting apparatus according to a sixth embodiment of the invention.

Finally, FIG. 13 shows a sixth embodiment of the invention. This embodiment is substantially similar to the foregoing third embodiment but is so simplified in the circuit construction that the comparator circuit 36 is composed of two circuits so that the comparator outputs based on one set of upper and lower limit threshold values corresponding to the P-range position are fed as the start allowing signal to the switching circuit 6 through the OR logic circuit 35. The remaining constructions are similar to those of the third embodiment so that the corresponding components will not be described by designating them by similar reference characters.

Although the invention has been described in detail in connection with the six embodiments, it should not be limited to those embodiments but could be practiced by changing the specific construction in various manners within the scope of the items defined in claims. For example, the control apparatus of this invention may be constructed to be built in not only the control device for controlling the automatic transmission but also the control device for the semiautomatic transmission, the control device for the continuously variable transmission, the vehicle control device for the vehicle having those individual transmissions mounted thereon, or the control device for the electric motor of the hybrid car or the vehicle control device, as has been enumerated hereinbefore. Where the invention is applied to the engine start of the hybrid car, on the other hand, the range position for the engine start should not be limited to the non-running range.

What is claimed is:

1. A prime mover starting control apparatus comprising:

a non-contact type position sensor for detecting the range position of a drive mechanism connected to a prime mover acting as a power source;

a control device for deciding the range position on the basis of the range position detected at least by the position sensor; and conduction means for making drive means for driving the prime mover and power source device for supplying an electric power to the drive means and the control device, conductive with a signal from an ignition switch and a signal outputted by the control device on the basis of the range position detected by said position sensor.

2. The prime mover starting control apparatus according to claim 1, wherein said conduction means includes a signal retaining circuit for retaining the signal outputted by the control device.

3. The prime mover starting control apparatus according to claim 2, wherein said signal retaining circuit is a circuit for retaining the present signal till a next signal is given, and for retaining the next signal by canceling the present signal with the next signal.

4. The prime mover starting control apparatus according to claim 3, wherein said signal retaining circuit is inserted into an output circuit of a signal outputted by the control device on the basis of the decision of the range position.

5. The prime mover starting control apparatus according to claim 4, further comprising control safety device in parallel with said control device capable of outputting the signal, as based on the range position detected at least by the position sensor, to the conduction means.

6. The prime mover starting control apparatus according to claim 5, wherein said control safety device includes an auxiliary control device for outputting a signal on the basis of the range position detected by the position sensor, and wherein said auxiliary control device warrants the output of the signal to the conduction means when the decision of the range position by the control device is reset.

7. The prime mover starting control apparatus according to claim 6, wherein said signal retaining circuit is a flip-flop circuit.

8. The prime mover starting control apparatus according to claim 7, wherein said flip-flop circuit inputs a decision signal of the range position and a position changing signal outputted at each change of said decision signal and outputs the decision signal of the range position outputted at the rise of said position changing signal, as the signal to the conduction means.

9. The prime mover starting control apparatus according to claim 8, wherein said range position is a non-running range position.

10. The prime mover starting control apparatus according to claim 1, further comprising control safety device in parallel with said control device capable of outputting the signal, as based on the range position detected at least by the position sensor, to the conduction means.

11. The prime mover starting control apparatus according to claim 1, wherein said range position is a non-running range position.

12. The prime mover starting control apparatus according to claim 2, wherein said signal retaining circuit is a logic circuit for retaining the signal inputted to said circuit with a gate output.

13. The prime mover starting control apparatus according to claim 12, further comprising control safety device in parallel with said control device capable of outputting the signal, as based on the range position detected at least by the position sensor, to the conduction means.

14. The prime mover starting control apparatus according to claim 2, wherein said signal retaining circuit is a circuit to be activated with a voltage lower than the working voltage necessary for deciding the range position by the control device, to retain the signal which has been outputted before the reset of the decision of the range position due to the drop of the working voltage of the control device.

15. The prime mover starting control apparatus according to claim 14, further comprising control safety device in parallel with said control device capable of outputting the signal, as based on the range position detected at least by the position sensor, to the conduction means.

16. The prime mover starting control apparatus according to claim 2, wherein said signal retaining circuit is inserted into an output circuit of a signal outputted by the control device on the basis of the decision of the range position.

17. The prime mover starting control apparatus according to claim 2, wherein said signal retaining circuit is a flip-flop circuit.

18. The prime mover starting control apparatus according to claim 5, wherein said control safety device includes a comparator circuit for outputting a signal on the basis of the range position detected by the position sensor, and wherein said comparator circuit warrants the output of the signal to the conduction means when the decision of the range position by the control device is reset.

19. The prime mover starting control apparatus according to claim 5, wherein said position sensor is a digital sensor, wherein said control safety device includes a decoder for converting the signal outputted by the digital sensor into a range position signal and for outputting the range position signal, and wherein said decoder warrants the output of the signal to the conduction means when the decision of the range position by the control device is reset.

20. The prime mover starting control apparatus according to claim 5, wherein said position sensor is an analog sensor, wherein said control safety device includes a comparator circuit for deciding the range position from the signal outputted by the analog sensor and for outputting the signal, and wherein said comparator circuit warrants the output of the signal to the conduction means when the decision of the range position by the control device is reset.

21. The prime mover starting control apparatus according to claim 5, wherein said signal retaining circuit is a flip-flop circuit.

22. A prime mover starting control apparatus comprising:

a non-contact type position sensor for detecting the range position of a drive mechanism connected to a prime mover acting as a power source; and a control device for deciding the range position on the basis of the range position detected at least by the position sensor, wherein:

said control device outputs a signal for making drive means for driving the prime mover and a power source device for supplying an electric power to the drive means and the control device, conductive on the basis of the range position detected by said position sensor.

23. The prime mover starting control apparatus according to claim 22, further comprising a signal retaining circuit for retaining the signal outputted by the control device.

24. The prime mover starting control apparatus according to claim 23, wherein said signal retaining circuit is a circuit for retaining the present signal till a next signal is given, and for retaining the next signal by canceling the present signal with the next signal.

25. The prime mover starting control apparatus according to claim 24, wherein said signal retaining circuit is inserted into an output circuit of a signal outputted by the control device on the basis of the decision of the range position.

26. The prime mover starting control apparatus according to claim 25, further comprising control safety device in parallel with said control device, wherein said control safety device can output the signal, as based on the range position detected at least by the position sensor, as a signal for making drive means for driving the prime mover and the power source device for supplying the electric power to the drive means and the control means, conductive.

27. The prime mover starting control apparatus according to claim 26, wherein said control safety device includes an auxiliary control device for outputting a signal on the basis of the range position detected by the position sensor, and wherein said auxiliary control device warrants the output of the signal for making the drive means for driving the prime mover and the power source device for supplying the electric power to the drive means and the control device, conductive when the decision of the range position by the control device is reset.

28. The prime mover starting control apparatus according to claim 15, wherein said range position is a non-running range position.

29. The prime mover starting control apparatus according to claim 23, wherein said signal retaining circuit is a logic circuit for retaining the signal inputted to said circuit with a gate output.

30. The prime mover starting control apparatus according to claim 23, wherein said signal retaining circuit is a circuit to be activated with a voltage lower than the working voltage necessary for deciding the range position by the control device, to retain the signal which has been outputted before the reset of the decision of the range position due to the drop of the working voltage of the control device.

* * * * *